United States Patent [19]

Sullivan

[11] 4,421,070

[45] Dec. 20, 1983

[54] STEAM COOLED HANGER TUBE FOR HORIZONTAL SUPERHEATERS AND REHEATERS

[75] Inventor: Robert P. Sullivan, Chattanooga, Tenn.

[73] Assignee: Combustion Engineering, Inc., Windsor, Conn.

[21] Appl. No.: 392,412

[22] Filed: Jun. 25, 1982

[51] Int. Cl.[3] ..... F22B 37/24

[52] U.S. Cl. ..... 122/510; 165/162

[58] Field of Search ..... 122/476, 478, 510; 165/76, 162, 172

[56] References Cited

U.S. PATENT DOCUMENTS

| | | | |
|---|---|---|---|
| 3,265,044 | 8/1966 | Juchterm | 122/510 |
| 3,267,913 | 8/1966 | Bruhl | 122/510 |
| 4,100,889 | 7/1978 | Chayes | 122/510 |
| 4,307,777 | 12/1981 | Chwyla | 165/76 |

*Primary Examiner*—Edward G. Favors

*Attorney, Agent, or Firm*—Robert L. Olson

[57] ABSTRACT

In combintion, a vertical gas pass (12) through which hot gases flow, a heat exchanger including a first tube panel (24, 26) having serpentine tube means, each tube means having a plurality of first (24, 26) horizontal tube portions, said heat exchanger having a second tube panel (32, 34) having serpentine tube means, each tube means having a plurality of second (32, 34) horizontal tube portions which lie adjacent to and in the same horizontal planes as the first (24, 26) horizontal tube portions, the upper terminal ends of the serpentine tube means having first vertical runs (24, 26) extending downwardly to a point beneath the bottom of the serpentine tube means, and having U-bends (28, 30) at the bottom, and having second vertical runs, which bend at the top and are integral with the uppermost horizontal tube portions, lug means (40) attached to opposite sides of some of the vertical runs (24, 26), a plurality of band means (42) encircling adjacent first and second horizontal tube portions (24, 32) the ends of the band means being attached (44, 46) to the lug means (40), each band means (42) being loose enough to permit relative movement between the two adjacent horizontal tube portions (24, 32), and also permit relative movement between the vertical run (26)and each of horizontal tube portions (24, 32).

2 Claims, 4 Drawing Figures

STEAM COOLED HANGER TUBE FOR HORIZONTAL SUPERHEATERS AND REHEATERS

BACKGROUND OF THE INVENTION

In steam generators heating surface is normally disposed in the vertical rear path leading from the furnace. This surface can be superheater, reheater or economizer tube panels, and is made up of sinuous tubes having parallel horizontal runs through which the fluid being heated flows. In large steam generators, it is necessary to support these horizontal runs in a manner which will permit unequal thermal expansion to take place in the various horizontal tube runs, without placing undue stress in the tubes.

SUMMARY OF THE INVENTION

The tube support of the invention includes sinuous tubes having horizontal runs, with vertical tubes supporting the horizontal runs. The vertical support tubes contain a U-bend therein, and form a part of the sinuous tubes themselves. The horizontal tube runs are supported from the vertical tube portions in such a manner that they permit relative movement therebetween.

DESCRIPTION OF THE PREFERRED EMBODIMENT

Figure 1:
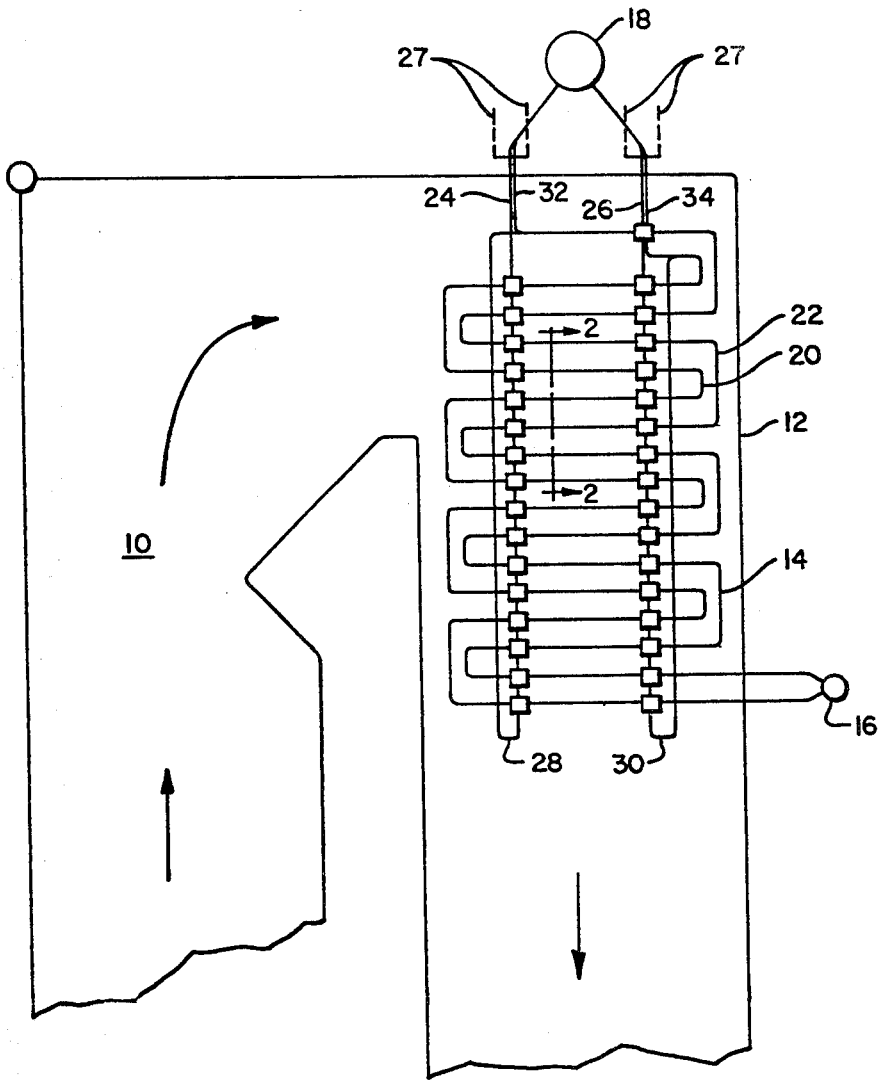
FIG. 1 is a schematic elevational section through a steam generator using the tube support of the invention.

Looking now to FIG. 1, numeral 10 designates the upper portion of a furnace of a steam generator, in which fuel is burned to generate hot combustion gases. The gases, after flowing upwardly through the furnace, pass downwardly through the rear gas pass 12, traversing the heat exchange surface 14 in so doing. This surface can be superheater or reheater, depending on the type of boiler it is utilized in. The surface is supplied from fluid from a supply header 16, and exits into header 18. There are a plurality of heat exchange panels 14, which lie in side-by-side relationship across the depth of the gas pass 12. The panels are made up of sinuous tubes, each of which has a horizontal portion. As shown, two tubes 20 and 22 are shown in the panel. The horizontal run or section of the tubes are supported by a pair of vertical hanger tube portions 24 and 26. Each vertical hanger tube supports a pair of horizontal runs, one on either side thereof. These hanger tubes are supported at an upper elevation by supports 27.

These vertical hanger tube portions 24 and 26 have U-bends 28 and 30 at their lower ends, and are integral with and form a part of the sinuous tubes of the panel.

Each vertical hanger tube portion 24 or 26 supports two horizontal tube runs, one on either side thereof. Thus the tubular panel directly behind the one shown in FIG. 1 does not contain any vertical support tubes or U-bends therein. The terminal end 32 and 34 of this panel form the sinuous tube arrangement of this panel (see FIGS. 2 and 3).

Figure 2:
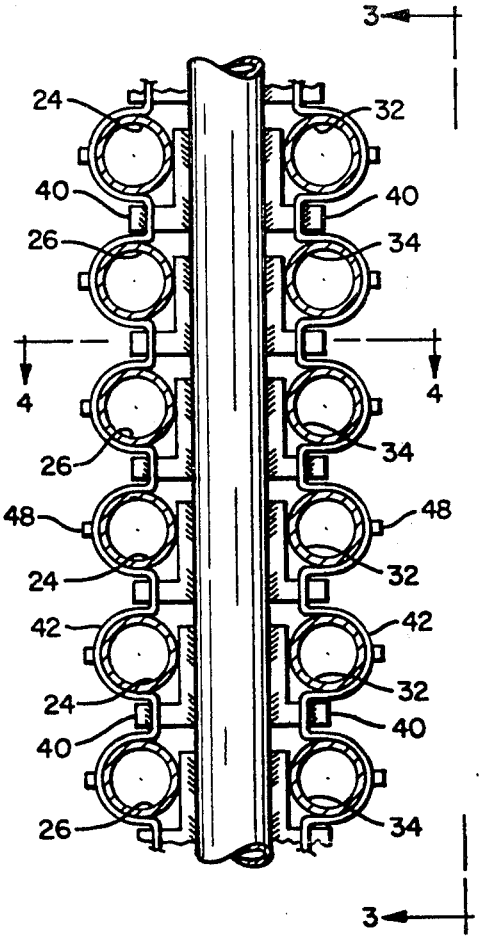
FIG. 2 is an enlarged view taken on line 2—2 of FIG. 1.
Figure 3:
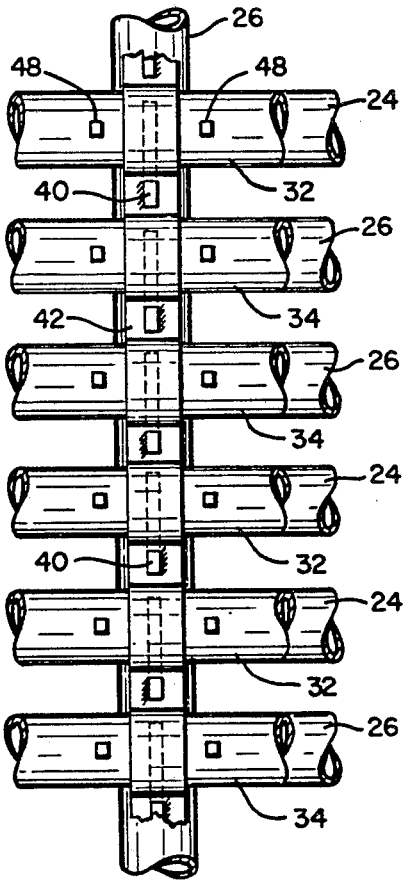
FIG. 3 is a view taken on line 3—3 of FIG. 2.
Figure 4:
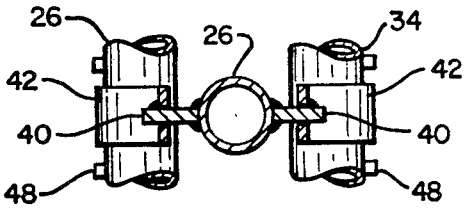
FIG. 4 is a view taken on line 4—4 of FIG. 2.

Looking now to FIGS. 2–4, the manner in which the horizontal tube portions are supported by the vertical runs is shown in detail. A vertical support run 26 is positioned with horizontal tube portions 24, 26 on one side, and horizontal tube portions 32, 34 on the other side. The other vertical support run 24 is identically arranged.

A plurality of L-shaped lugs 40 are welded on opposite sides of the vertical tube run 26. The horizontal tube portions 24, 26, and 32, 34 are located adjacent the vertical leg of the lug. A band 42 surrounds each of the horizontal tube portions, and is welded at 44, 46 to the lugs 40 both above and below the tube. The bands are loose enough to permit longitudinal thermal growth of the horizontal tube portions with respect to each other, and the vertical support run without overstressing any of the tubes. Stop lugs 48 are welded to the horizontal tube runs to prevent damage to the support arrangements in the event they would sway sufficiently to contact the adjacent panel. From the above it can be seen that a support arrangement has been provided which is simple, inexpensive, and trouble-free.

I claim:

1. In combination, a vertical gas pass through which hot gases flow, a heat exchanger including a first tube panel having serpentine tube means, each tube means having a plurality of first horizontal tube portions, said heat exchanger having a second tube panel having serpentine tube means, each tube means having a plurality of second horizontal tube portions which lie adjacent to and in the same horizontal planes as the first horizontal tube portions, the upper terminal ends of the serpentine tube means having first vertical runs extending downwardly to a point beneath the bottom of the serpentine tube means, and having U-bends at the bottom, and having second vertical runs, which bend at the top and are integral with and form the upper-most horizontal tube portions, lug means attached to opposite sides of some of the vertical runs, a plurality of band means encircling adjacent first and second horizontal tube portions, the ends of the band means being attached to the lug means, each band means being loose enough to permit relative movement between the two adjacent horizontal tube portions, and also permit relative movement between the vertical run and each of the horizontal tube portions.

2. The combination set forth in claim 1, wherein the first and second tube panels each have at least two internested tube means, and the vertical runs supporting the horizontal tube portions are part of the first tube panel.

* * * * *